US012702219B2

(12) United States Patent
Ledet et al.

(10) Patent No.: US 12,702,219 B2
(45) Date of Patent: Aug. 11, 2026

(54) TOOTHBRUSH WITH MULTIPLE BRUSHING SURFACES

(71) Applicant: CENTER FOR DISABILITY SERVICES, Albany, NY (US)

(72) Inventors: Eric Howard Ledet, Schenectady, NY (US); Elizabeth Ann Capogna, Rexford, NY (US); Nicole Zimmer, Chittenango, NY (US); Alexandria M. Brooks, Grahamsville, NY (US); Brianna D. Callahan, Milton, MA (US); Alexander A Diaz, Pasadena, CA (US); Laura M. Gay, Kalispell, MT (US); John W. Neill, Woodstock, CT (US); Brett P. Rooney, Seaford, NY (US)

(73) Assignee: CENTER FOR DISABILITY SERVICES, Albany, NY (US)

( * ) Notice: Subject to any disclaimer, the term of this patent is extended or adjusted under 35 U.S.C. 154(b) by 0 days.

(21) Appl. No.: 19/307,389

(22) Filed: Aug. 22, 2025

(65) Prior Publication Data

US 2025/0386924 A1 Dec. 25, 2025

Related U.S. Application Data

(63) Continuation of application No. 17/053,126, filed as application No. PCT/US2019/031096 on May 7, 2019, now abandoned.

(Continued)

(51) Int. Cl.

| | |
|---|---|
| ***A46B 9/04*** | (2006.01) |
| ***A46B 5/02*** | (2006.01) |
| ***A46B 9/02*** | (2006.01) |

(52) U.S. Cl.
CPC ..... *A46B 9/045* (2013.01); *A46B 5/02* (2013.01); *A46B 9/025* (2013.01); *A46B 2200/1066* (2013.01)

(58) Field of Classification Search
None
See application file for complete search history.

(56) References Cited

U.S. PATENT DOCUMENTS 4,399,582 A * 8/1983 Ernest ..... A46B 5/02 15/176.4
8,887,338 B1 * 11/2014 Brar ..... A46B 9/045 15/22.1
11,191,348 B2 * 12/2021 Agudo Crespo .... A46B 5/0058

FOREIGN PATENT DOCUMENTS

KR 100922289 B1 * 10/2009 ..... A46B 15/0095
WO WO-8901303 A1 * 2/1989 ..... A46B 5/0025

OTHER PUBLICATIONS

Kang (KR 100922289) including a machine translation (Year: 2009).*

(Continued)

*Primary Examiner* — Monica S Carter
*Assistant Examiner* — Jonathan R Zaworski
(74) *Attorney, Agent, or Firm* — Hoffman Warnick LLC

(57) ABSTRACT

Aspects include a toothbrush and related methods of brushing teeth. In some cases, a toothbrush includes: a head including an approximately dumbbell-shaped core and a set of brushing portions extending from the approximately dumbbell-shaped core, the set of brushing portions including an upper brushing portion and a lower brushing portion, wherein the upper brushing portion and the lower brushing portion are oriented and spaced apart relative to one another to enable a provider to brush upper teeth and lower teeth of another person without removing the head from the mouth of the other person, and a handle coupled with the head, the (Continued)

handle including at least one longitudinal portion positioned relative to the head such that a hand of the provider is oriented at a distinct angle from the head while brushing the teeth of the other person and holding the at least one longitudinal portion.

16 Claims, 15 Drawing Sheets

Related U.S. Application Data

(60) Provisional application No. 62/762,441, filed on May 7, 2018.

(56) References Cited

OTHER PUBLICATIONS

Haeusser (WO 8901303) including a machine translation (Year: 1989).*

* cited by examiner

TOOTHBRUSH WITH MULTIPLE BRUSHING SURFACES

CROSS-REFERENCE TO RELATED APPLICATION(S)

This application is a continuation of, and claims priority to, co-pending U.S. patent application Ser. No. 17/053,126 (filed Nov. 5, 2020), which is a 371 filing of PCT/US19/31096 (filed May 7, 2019), which claims priority to U.S. Provisional Patent Application Ser. No. 62/762,441 (filed May 7, 2018), the entire contents of each of which is incorporated herein by reference in its entirety.

TECHNICAL FIELD

The present disclosure relates to oral hygiene, and more specifically to toothbrushes, e.g., toothbrushes designed to allow a provider to brush the teeth of a subject (e.g., another person).

BACKGROUND

Conventional toothbrushes are generally designed for self-brushing of teeth. As such, conventional toothbrushes include, typically, a single brushing surface with bristles, and a handle that is sized and configured to facilitate individuals performing the activity of tooth brushing of their own teeth, when holding the toothbrush by a handle. Conventionally, toothbrushes have a single brushing surface and bristles that are approximately perpendicular to the long axis of the handle, and makes full contact with only one surface of the teeth at a time. For example, a conventional toothbrush may be used to first brush the inner surface of the lower teeth, then turned 180 degrees to brush the inner surface of the upper teeth. In addition, a conventional toothbrush must be fully repositioned from within or outside the mouth during usage.

Some toothbrushes do include multiple brushing surfaces. For example, U.S. Pat. No. 5,327,607A to Wagner discloses a toothbrush that includes three brushing surfaces that are angled together to form a concavity that may contact the inner, outer and brushing surfaces of a single tooth simultaneously. However, Wagner did not contemplate the notion that a provider would use a toothbrush to brush the teeth of a subject, and the toothbrush of Wagner does not brush the upper and lower teeth surface at the same time.

In another example, U.S. Patent Application Publication No. 2002/0157202 A1 to Hartel discloses a toothbrush similar to Wagner's toothbrush with a concavity containing the brushing surfaces, but also includes a fourth brushing surface and makes use of a flexible joint. Hartel also sets forth a recounting of numerous U.S. patents directed to toothbrushes. However, Hartel did not contemplate the notion that a provider would use a toothbrush to brush the teeth of a subject, and the toothbrush of Hartel does not brush the upper and lower teeth surface at the same time.

In a further example, U.S. Pat. No. 6,119,296 A to Noe et al. discloses a toothbrush having a head with a single brushing surface that extends parallel to the handle, and the opposite side of the brushing surface includes an alternate cleaning device for cleaning the tongue or gums. However, Noe et al. did not contemplate the notion that a provider would use a toothbrush to brush the teeth of a subject, and the toothbrush of Hartel does not brush the upper and lower teeth surface at the same time.

SUMMARY

All examples and features mentioned below can be combined in any technically possible way.

In certain embodiments, a toothbrush head is presented. The toothbrush head includes a first brushing portion, and a second brushing portion. A first orientation of the toothbrush head includes the first brushing portion contacting an inside of at least one upper tooth and the second brushing portion contacting an outside of at least one lower tooth. A second orientation of the toothbrush head includes the first brushing portion contacting an inside of at least one lower tooth and the second brushing portion contacting an outside of at least one upper tooth.

In other embodiments, a method for brushing at least one upper tooth and at least one lower tooth of a subject is presented. The method includes steps as follows: a) contacting, with a toothbrush head, an inside of at least one upper tooth concurrently with an outside of at least one lower tooth; and b) contacting, with the toothbrush head, an inside of at least one lower tooth concurrently an outside of at least one upper tooth.

In further embodiments, a toothbrush for brushing at least one upper tooth and at least one lower tooth of a subject is presented. The toothbrush includes a toothbrush head and a handle. The toothbrush head includes a first brushing portion and a second brushing portion. A first orientation of the toothbrush head includes the first brushing portion contacting an inside of at least one upper tooth and the second brushing portion contacting an outside of at least one lower tooth. A second orientation of the toothbrush head includes the first brushing portion contacting an inside of at least one lower tooth and the second brushing portion contacting an outside of at least one upper tooth. The handle is operably coupled to the toothbrush head to facilitate rotation of the toothbrush head by an acute angle about an axis extending along the handle to move the toothbrush head between the first orientation and the second orientation.

In further embodiments, a toothbrush includes: a head including an approximately dumbbell-shaped core and a set of brushing portions extending from the approximately dumbbell-shaped core, the set of brushing portions including an upper brushing portion and a lower brushing portion, wherein the upper brushing portion and the lower brushing portion are oriented and spaced apart relative to one another to enable a provider to brush upper teeth and lower teeth of another person without removing the head from the mouth of the other person, and a handle coupled with the head, the handle including at least one longitudinal portion positioned relative to the head such that a hand of the provider is oriented at a distinct angle from the head while brushing the teeth of the other person and holding the at least one longitudinal portion.

In further embodiments, a method of brushing the teeth of another person, performed by a provider, includes: at least partially inserting a toothbrush into the mouth of the other person, with the toothbrush in the mouth of the other person: a) contacting an inside of at least one upper tooth and concurrently contacting an outside of at least one lower tooth, and b) contacting an inside of at least one lower tooth and concurrently contacting an outside of at least one upper tooth, wherein (a) and (b) are performed without removing the toothbrush from the mouth of the other person.

In further embodiments, a toothbrush includes: a head including an approximately dumbbell-shaped core and a set of brushing portions extending from the approximately dumbbell-shaped core, the set of brushing portions including an upper brushing portion and a lower brushing portion, wherein the upper brushing portion and the lower brushing portion are oriented and spaced apart relative to one another to enable a user of the toothbrush to brush upper teeth and lower teeth of another person without removing the toothbrush from the mouth of the other person, wherein a depth of the head is less than one-half a width thereof to facilitate insertion of the head into the mouth of the other person, and a handle coupled with the head, the handle including at least one longitudinal portion positioned relative to the head such that a hand of the provider is oriented at a distinct angle from the head while brushing the teeth of the other person and holding the at least one longitudinal portion.

Implementations may include one of the following features, or any combination thereof.

In certain cases, a provider is one who brushes the teeth of the other person (or, another person).

In certain cases, the at least one longitudinal portion of the handle is positioned relative to the head to enable the hand of the provider to remain in a handshake position while brushing the teeth of the other person.

In certain cases, the handshake position includes a neutral wrist, a sideways facing palm, and fingers and thumb wrapped opposably around the at least one longitudinal portion of the handle.

In certain cases, the handle has an offset from the head allowing the user to view the mouth of the other person while brushing the upper teeth and the lower teeth.

In certain cases, the head enables brushing of an entirety of the teeth of the other person without removing the head from the mouth of the other person.

In certain cases, a depth of the head is less than one-half a width thereof to facilitate insertion of the head into the mouth of the other person.

In certain cases, the head enables brushing the upper teeth and the lower teeth of the other person without rotating the handle more than 90 degrees along an axis of the handle.

In certain cases, the upper brushing portions include three distinct upper brushing surfaces and wherein the lower brushing portion includes three distinct lower brushing surfaces, each of the distinct brushing surfaces having a set of bristles for brushing the teeth of the other person.

In certain cases, the handle includes at least two distinct grip portions.

In certain cases, the handle includes two distinct longitudinal portions that are offset from one another by a connecting portion to facilitate the user viewing the mouth of the other person while brushing the teeth.

In certain cases, a method of brushing the teeth of another person uses the toothbrush, the method including: at least partially inserting the head into the mouth of the other person, with the head at least partially in the mouth of the other person: a) contacting an inside of at least one upper tooth and concurrently contacting an outside of at least one lower tooth, and b) contacting an inside of at least one lower tooth and concurrently contacting an outside of at least one upper tooth, wherein (a) and (b) are performed without removing the head from the mouth of the other person.

In certain cases, the head is sized and configured such that moving between (a) and (b) can be performed without removing the head from the mouth of the other person.

In certain cases, switching between (a) and (b) is performed by rotating the handle by an acute angle.

In certain cases, the method further includes repeating processes (a) and (b) for all teeth in the mouth of the other person without removing the head from the mouth of the other person.

In certain cases, the toothbrush is sized and configured such that moving between (a) and (b) can be performed without removing the toothbrush from the mouth of the other person, wherein switching between (a) and (b) is performed by rotating the handle by an acute angle, and wherein the method further comprises: repeating processes (a) and (b) for all teeth in the mouth of the other person without removing the toothbrush from the mouth of the other person.

In certain cases, the toothbrush includes: a head including an approximately dumbbell-shaped core and a set of brushing portions extending from the approximately dumbbell-shaped core, the set of brushing portions including an upper brushing portion and a lower brushing portion, wherein the upper brushing portion and the lower brushing portion are oriented and spaced apart relative to one another to enable a user of the toothbrush to brush upper teeth and lower teeth of another person without removing the toothbrush from the mouth of the other person, and a handle coupled with the head, the handle including at least one longitudinal portion positioned relative to the head such that a hand of the provider is oriented at a distinct angle from the head while brushing the teeth of the other person and holding the at least one longitudinal portion.

In certain cases, the at least one longitudinal portion of the handle is positioned relative to the head to enable the hand of the provider to remain in a handshake position while brushing the teeth of the other person, wherein the handle further includes an offset from the head allowing the user to view the mouth of the other person while brushing the upper teeth and the lower teeth, wherein the head enables brushing of an entirety of the teeth of the other person without removing the head from the mouth of the other person, and wherein a depth of the head is less than one-half a width thereof to facilitate insertion of the head into the mouth of the other person prior to (a) and (b).

In certain cases, the handle further comprises an offset from the head allowing the user to view the mouth of the other person while brushing the upper teeth and the lower teeth, wherein the head enables brushing of an entirety of the teeth of the other person without removing the head from the mouth of the other person, and wherein the depth of the head is less than one-third the width thereof to facilitate insertion of the head into the mouth of the other person.

Two or more features described in this disclosure, including those described in this summary section, may be combined to form implementations not specifically described herein.

The details of one or more implementations are set forth in the accompanying drawings and the description below. Other features, objects and benefits will be apparent from the description and drawings, and from the claims.

The above embodiments are exemplary only. Other embodiments are within the scope of the disclosed subject matter.

BRIEF DESCRIPTION OF THE SEVERAL VIEWS OF THE DRAWINGS

A more particular description of the invention briefly summarized above may be had by reference to the embodiments, some of which are illustrated in the accompanying drawings. It is to be noted, however, that the appended drawings illustrate only typical embodiments of this invention and are therefore not to be considered limiting of its scope, for the invention may admit to other equally effective embodiments. Thus, for further understanding of the nature and objects of the invention, references can be made to the following detailed description, read in connection with the drawings in which.

DETAILED DESCRIPTION

Figure 1A:
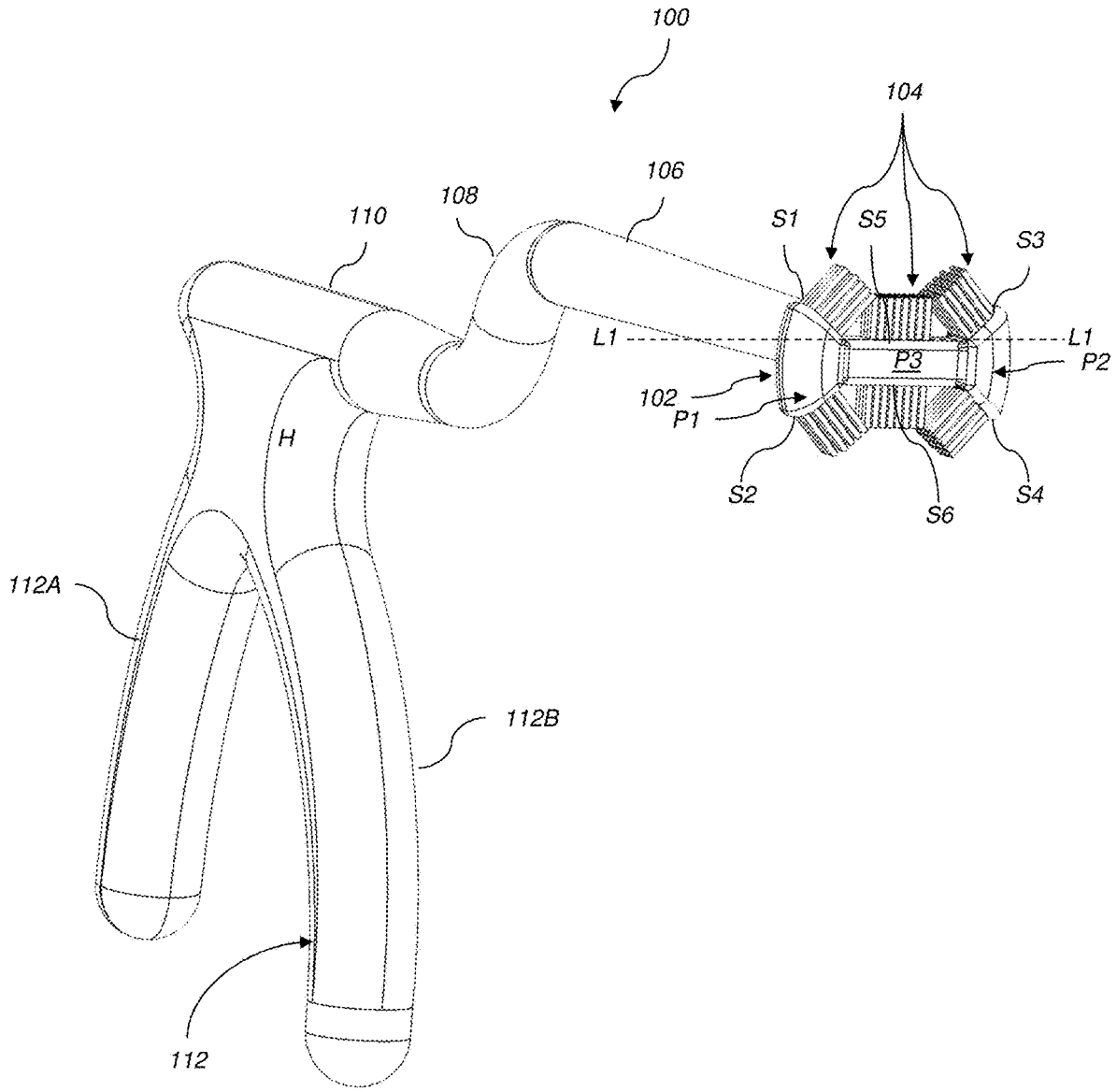
FIG. 1A depicts a toothbrush, in accordance with one or more aspects set forth herein.

The present disclosure relates to toothbrushes and toothbrush heads, and in particular, toothbrushes that overcome the limitations of conventional toothbrushes especially when used by a provider, such as a nurse or any other provider or caregiver, to brush the teeth of a subject. Advantageously, multiple tooth surfaces, including the inside, outside and biting surfaces, may be brushed at the same time. As another advantage, the teeth may be brushed without removing the toothbrush from the subject's mouth or without rotating more than 90 degrees. These features and advantages allow a provider or nurse to more readily brush the teeth of a disabled consumer, because oftentimes a disabled consumer may resist the repeated insertion and removal of a toothbrush because of the discomfort caused. Thus, the techniques of the present disclosure represent a marked improvement in the ability to care for such consumers and improve their oral hygiene.

Generally stated, provided herein, in one aspect is a toothbrush head for brushing at least one upper tooth and at least one lower tooth of a subject. For instance, the toothbrush head includes a first brushing portion, and a second brushing portion. A first orientation of the toothbrush head includes the first brushing portion contacting an inside of at least one upper tooth and the second brushing portion contacting an outside of at least one lower tooth. A second orientation of the toothbrush head includes the first brushing portion contacting an inside of at least one lower tooth and the second brushing portion contacting an outside of at least one upper tooth.

In one example, rotation of the toothbrush head by an acute angle about an axis extending away from the subject results in the toothbrush head moving between the first orientation and the second orientation. In another example, the toothbrush head is capable of moving between the first orientation and the second orientation without translation away from the subject. In a further example, included are a third brushing portion and a fourth brushing portion, and the first and second orientations of the toothbrush head include the third brushing portion contacting a biting surface of at least one upper tooth and the fourth brushing portion contacting a biting surface of at least one lower tooth.

In one implementation, the first brushing portion includes two brushing surfaces. In another implementation, the second brushing portion includes two brushing surfaces. In a further implementation, the two brushing surfaces comprise opposite brushing surfaces. In another implementation, the two brushing surfaces angle inward.

In another aspect, presented herein is a method for brushing an upper tooth and a lower tooth of a subject. The method includes steps as follows: a) contacting, with a toothbrush head, an inside of at least one upper tooth concurrently with an outside of at least one lower tooth; and b) contacting, with the toothbrush head, an inside of at least one lower tooth concurrently an outside of at least one upper tooth.

In one embodiment, the method further includes at least partially inserting the toothbrush head into a mouth of the subject. In such a case, the contacting steps a) and b) are performed without removing the toothbrush head from the mouth of the subject.

In another example, the contacting steps a) and b) each include contacting, with the toothbrush head, biting surfaces of at least one lower tooth and the upper tooth.

In a further aspect, a toothbrush for brushing an upper tooth and a lower tooth of a subject is presented. The toothbrush includes a toothbrush head and a handle. The toothbrush head includes a first brushing portion and a second brushing portion. A first orientation of the toothbrush head includes the first brushing portion contacting an inside of at least one upper tooth and the second brushing portion contacting an outside of at least one lower tooth. A second orientation of the toothbrush head includes the first brushing portion contacting an inside of at least one lower tooth and the second brushing portion contacting an outside of at least one upper tooth. The handle is operably coupled to the toothbrush head to facilitate rotation of the toothbrush head by an acute angle about an axis extending along the handle to move the toothbrush head between the first orientation and the second orientation.

In one embodiment, the toothbrush head is sized and configured such that moving between the first orientation and the second orientation may be performed without removing the toothbrush head from the mouth of the subject. In another embodiment, the toothbrush head has a dumbbell shape.

In one embodiment, FIG. 1A depicts a toothbrush 100, which includes a toothbrush head 102 and a handle 112. Toothbrush head 102 includes a first brushing portion P1, a second brushing portion P2, and a third brushing portion P3 connecting the first and second brushing portions P1, P2. The brushing portions P1, P2 and P3 form a dumbbell shape. Note that portions P1 and P2 each have a convex rounded shape at their extremities (the portions pointed to by the arrows for P1 and P2 in the figures.) The first brushing portion P1 includes two brushing surfaces S1, S2. The second brushing portion P2 includes two brushing surfaces S3, S4. The third brushing portion P3 includes two brushing surfaces S5, S6. Each of the brushing surfaces S1-S6 includes bristles 104, which are depicted as bundles of bristles with the individual bristles in each bundle not shown due to their small size. In addition, the toothbrush head 102 is oriented along line L1-L1 that passes through the brushing portions P1, P2 and P3.

Notably, brushing surfaces S1 and brushing surface S2 of first brushing portion P1 are angled inward. Similarly, brushing surface S3 and brushing surface S4 of second brushing portion P2 are also angled inward. The handle 112 of the toothbrush 100 includes grip portions 112A, 112B for use by a provider or nurse.

The toothbrush handle 112 and head 102 portions may be made using any thermoplastic material, such as moldable plastics including polypropylene, polyethylene, or the like, using any conventional molding technology. The toothbrush 100 may be molded in a single piece or multiple piece, and the molding process may also be used to form holes for the bristles, grip surfaces, etc. The bristles 104 may be made using nylon or any suitable material, which may be attached, e.g., to the holes imprinted in the toothbrush head during the molding process. Such attachment may be achieved by folding a bundle of bristles in half and inserting into the holes, and may be held in place through compressive forces in the holes or any other attachment means. Rows and columns of the bristles 104 are depicted in FIG. 1A. The different brushing surfaces can have any number of rows and columns of holes (e.g., 12×10), and each hole can have any number of bristles (e.g., 40-50 bristles per hole).

Figure 1B:
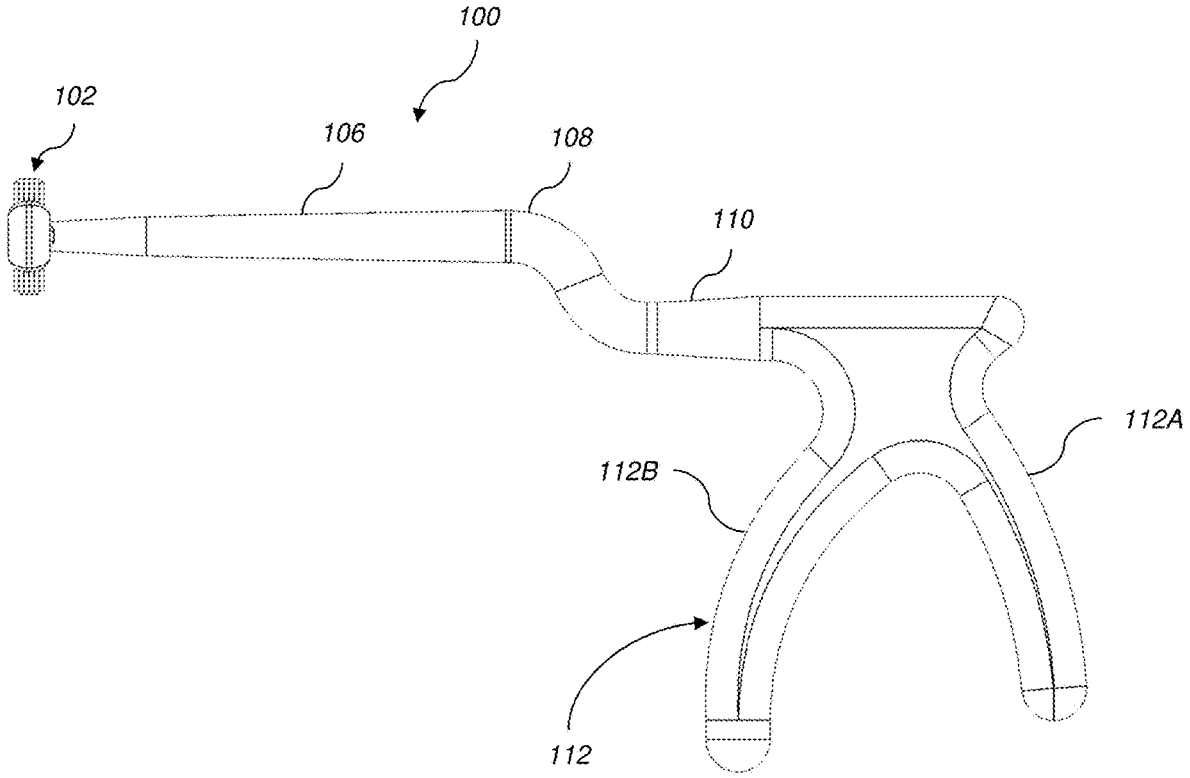
FIG. 1B depicts a side view of the toothbrush of FIG. 1A, in accordance with one or more aspects set forth herein.
Figure 1C:
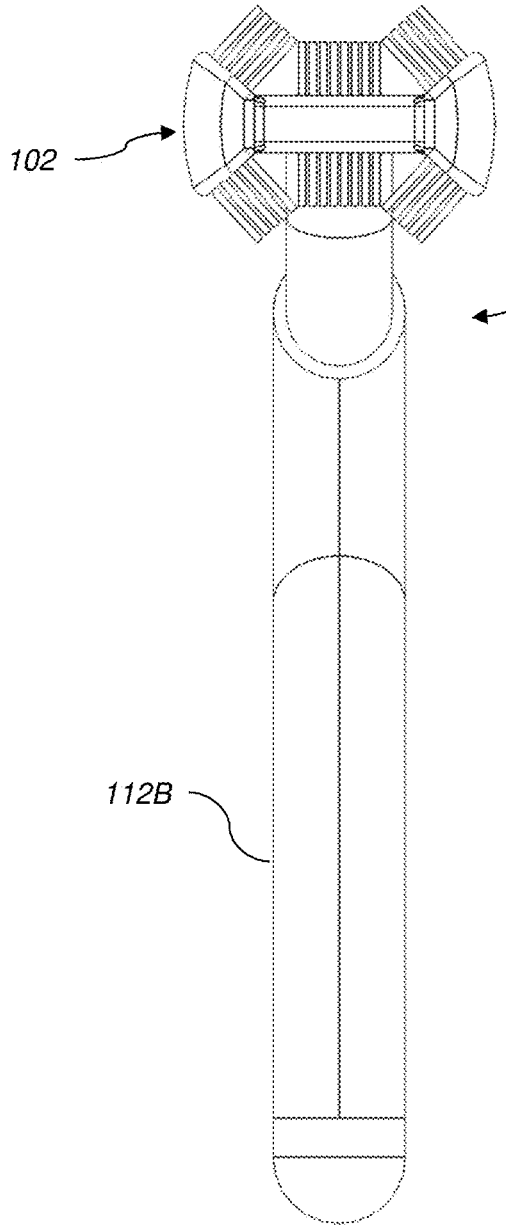
FIG. 1C depicts a front view of the toothbrush of FIG. 1A, in accordance with one or more aspects set forth herein.
Figure 1D:
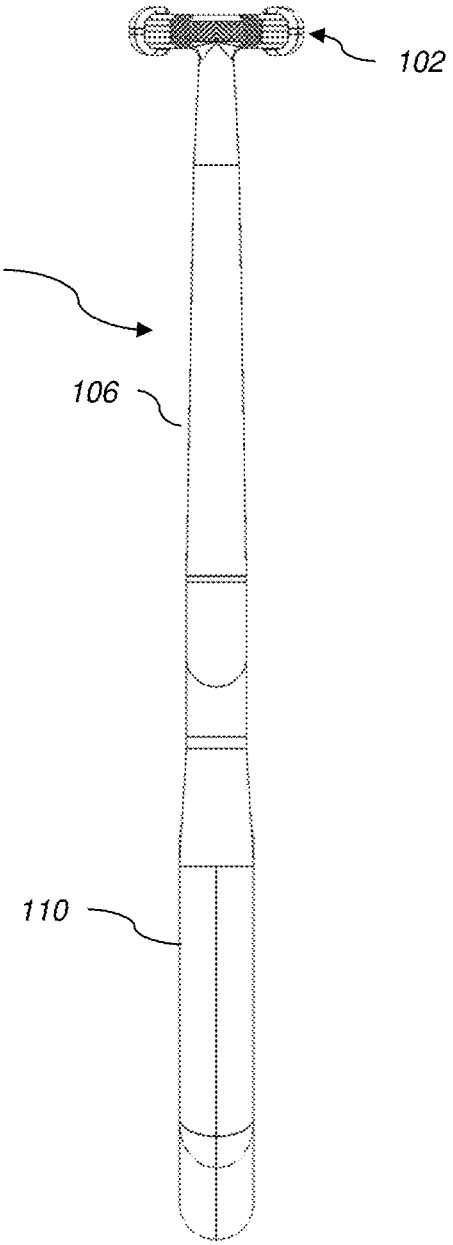
FIG. 1D depicts a top view of the toothbrush of FIG. 1A, in accordance with one or more aspects set forth herein.
Figure 1E:
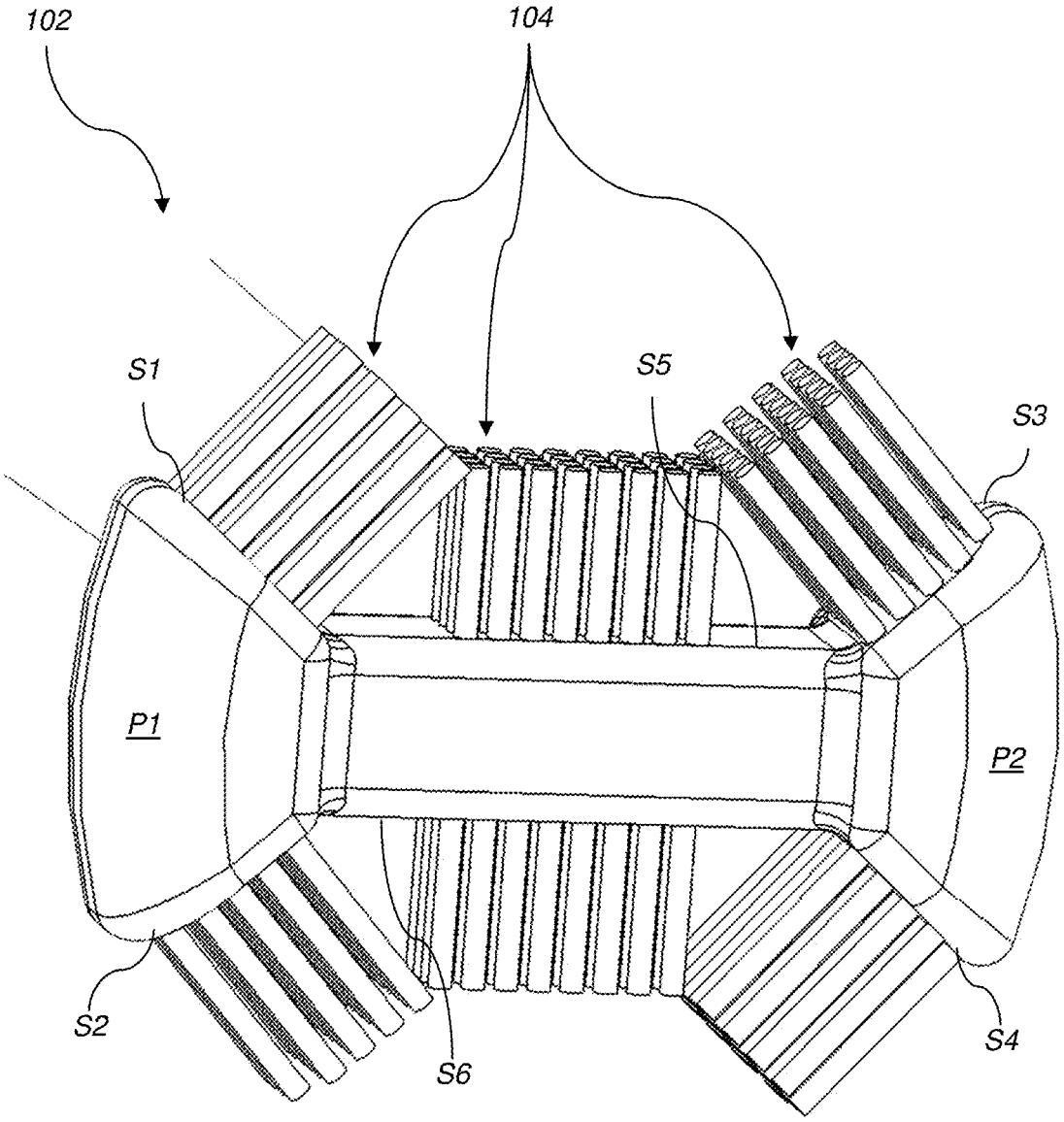
FIG. 1E depicts an enlarged front view of the toothbrush of FIG. 1A, in accordance with one or more aspects set forth herein.
Figure 1F:
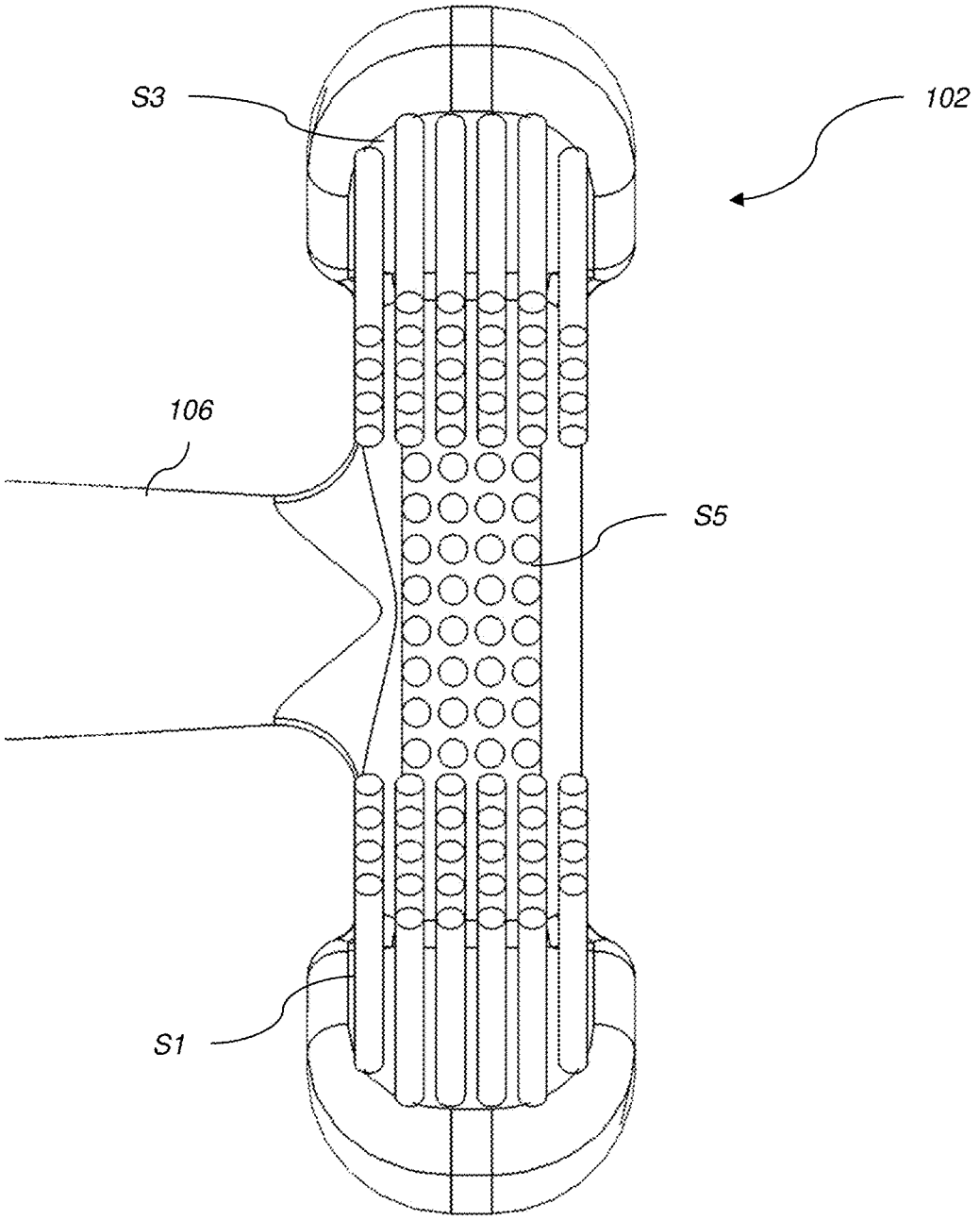
FIG. 1F depicts an enlarged top view of the toothbrush of FIG. 1A, in accordance with one or more aspects set forth herein.
Figure 1G:
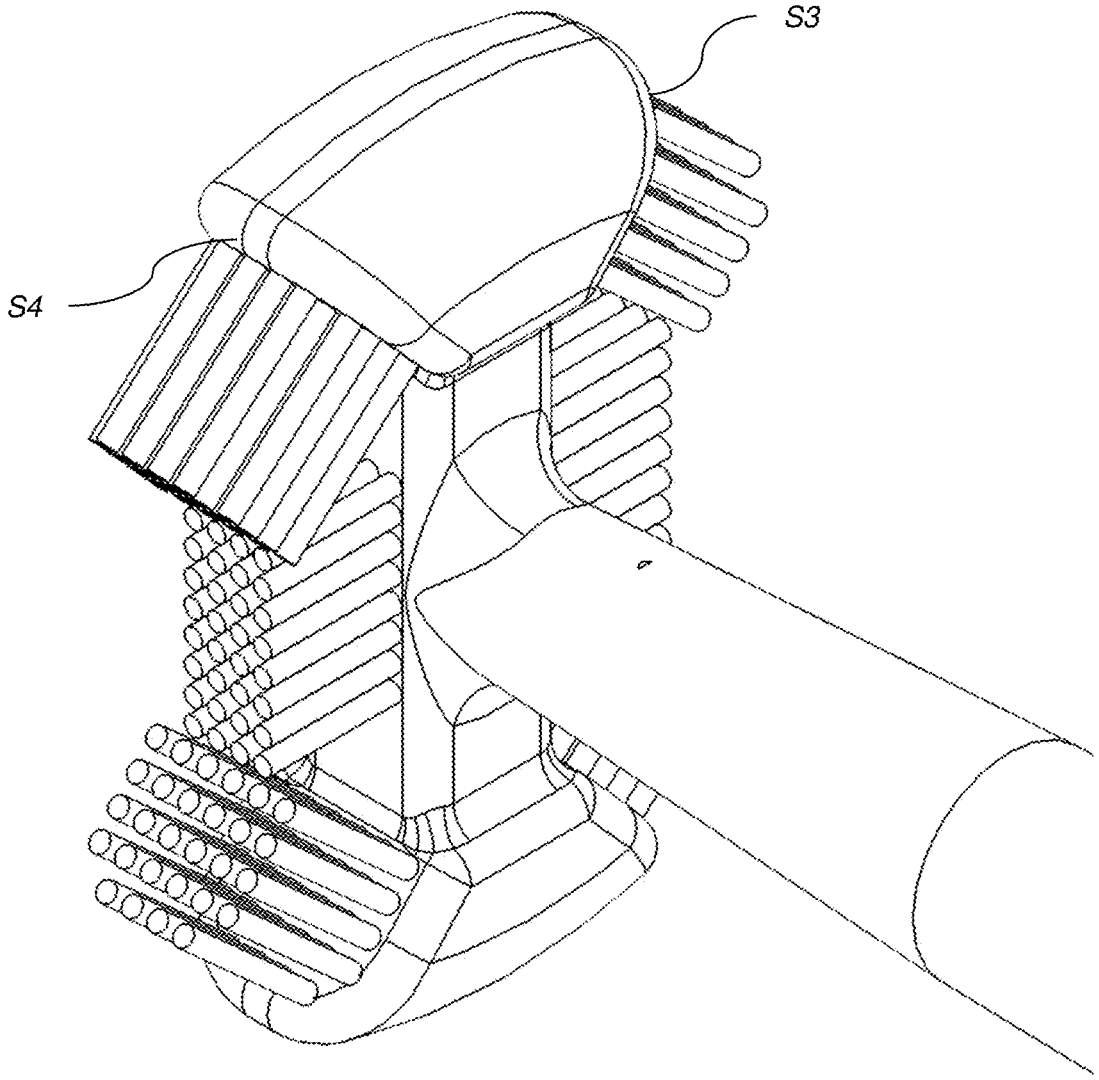
FIG. 1G depicts an enlarged back view of the [head of the ???] toothbrush of FIG. 1A, in accordance with one or more aspects set forth herein.

FIG. 1B depicts a side view of the toothbrush 100. As readily visible in the view of FIG. 1A, the handle 112 also includes two longitudinal portions 106 and 110 that are offset from one another by a connecting portion 108. The offset longitudinal portion 106 prevents the toothbrush handle 112 from blocking the provider's view of the subject's mouth during brushing. FIG. 1C depicts a front view of the toothbrush 100. FIG. 1D depicts a top view of the toothbrush 100. FIG. 1E depicts an enlarged front view of the toothbrush 100. FIG. 1F depicts an enlarged top view of the toothbrush 100. FIG. 1G depicts an enlarged back view of the toothbrush 100.

Figure 2A:
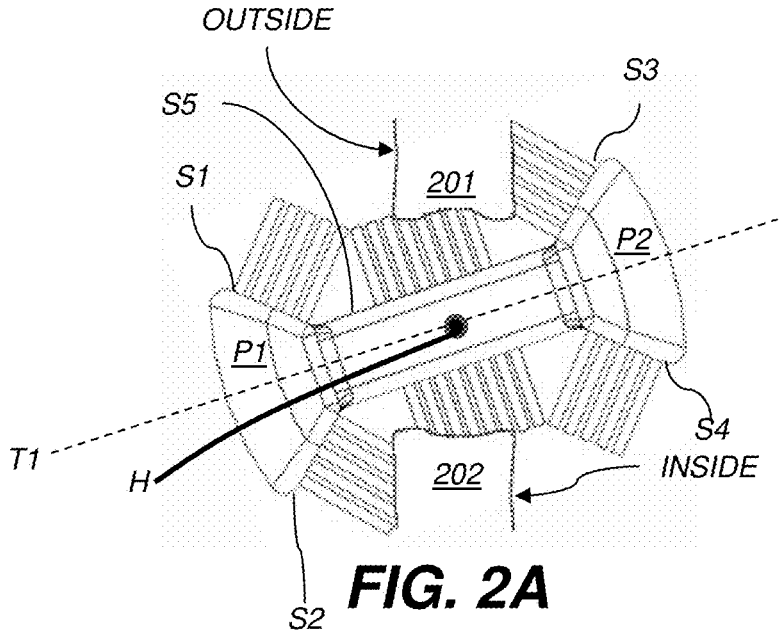
FIGS. 2A & 2B depict a toothbrush head for brushing an upper tooth and a lower tooth of a subject in a first and second orientation, respectively, in accordance with one or more aspects set forth herein.
Figure 2B:
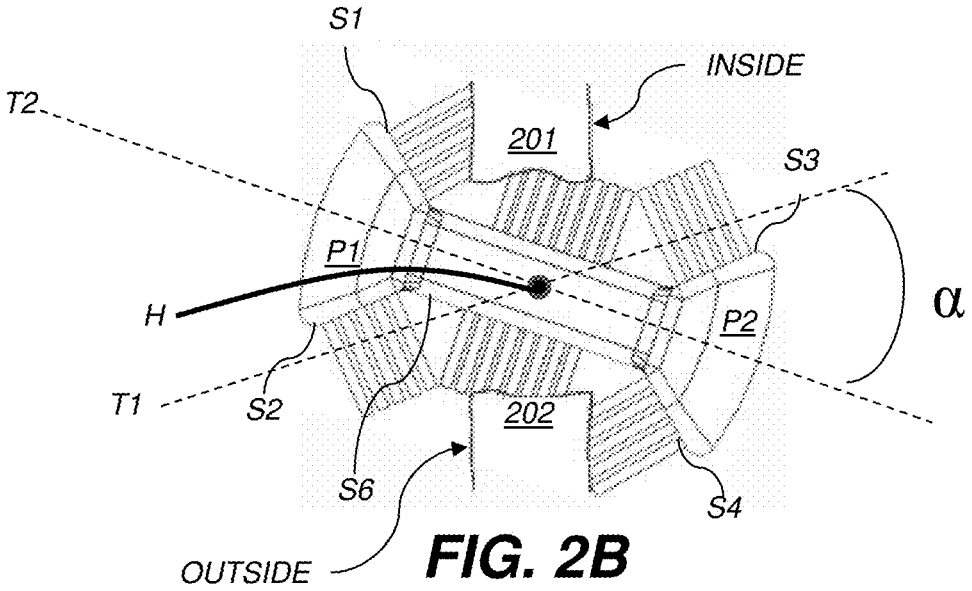

FIG. 2A depicts a toothbrush head 102 contacting or brushing an upper tooth 201 and a lower tooth 202 of a subject in a first orientation T1. FIG. 2B depicts the toothbrush head 102 contacting or brushing the upper tooth 201 and the lower tooth 202 of the subject in a second orientation T2.

As depicted in FIG. 2A, the first orientation T1 of the toothbrush head includes the brushing portion S3 contacting an inside of the upper tooth 201 and the brushing portion S2 contacting an outside of the lower tooth 202, at the same time.

As depicted in FIG. 2B, the second orientation T2 of the toothbrush head includes the brushing portion S3 contacting an inside of the lower tooth 202 and the brushing portion S2 contacting an outside of the upper tooth 201.

Second orientation T2 is achieved by rotating the toothbrush head 112 by an acute angle α about the axis H, which is the axis of the handle, without translating the handle 112. Advantageously, such a configuration allows for moving between the first orientation T1 and the second orientation T2 without translation of the toothbrush head 112 away from the subject.

Figure 3:
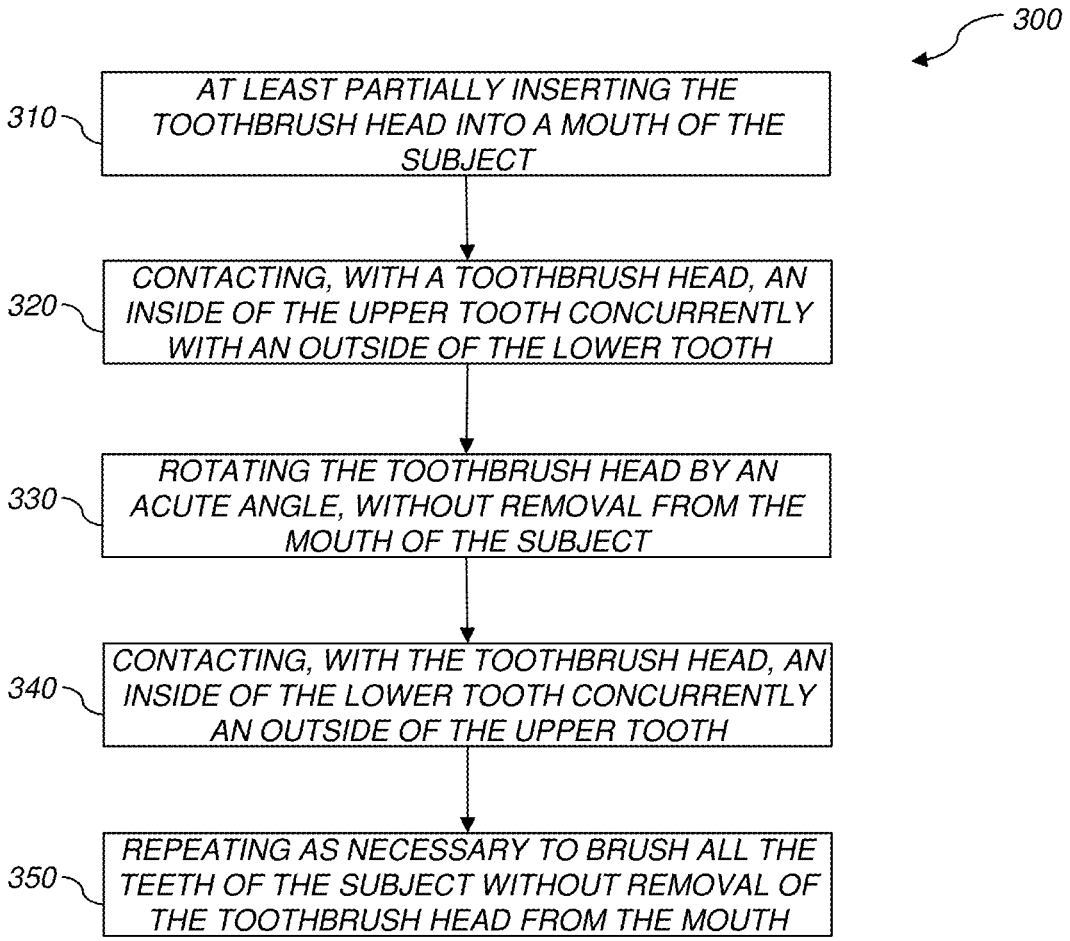
FIG. 3 depicts a method for brushing an upper tooth and a lower tooth of a subject, in accordance with one or more aspects set forth herein.

FIG. 3 depicts a method 300 for brushing at least one upper tooth (e.g., upper tooth 201 of FIGS. 2A&2B) and at least one lower tooth (e.g., lower tooth 202 of FIGS. 2A&2B) of a subject. For instance, at step 310 a provider at least partially inserts the toothbrush (e.g., toothbrush 100 of FIGS. 2A&2B) into a mouth of the subject. Next, at step 320, the provider contacts, with the toothbrush head (e.g., toothbrush head 112 of FIGS. 2A&2B), an inside of at least one upper tooth 201 concurrently with an outside of at least one lower tooth 202. Next, at step 330, the provider rotates the toothbrush 112 by an acute angle (e.g., angle α of FIGS. 2A&2B), without removing the toothbrush head 112 from the mouth of the subject. Next, at step 340, the provider contacts, with the toothbrush head 112, an inside of at least one lower tooth 202 concurrently with an outside of at least one upper tooth 201. The steps 320-340 may then be repeated as necessary while moving the brush sideways, to brush all of the teeth of the subject without having to remove the toothbrush head from the subject's mouth.

The embodiments depicted in FIGS. 4-19 may be mixed and matched with the embodiment of FIG. 1A, in order to make a toothbrush and toothbrush head with a desired handle and head combination to achieve one or more of the goals of brushing multiple tooth surfaces at the same time, minimizing the number of insertions and removals of the toothbrush, etc. For example, tradeoffs may be made between the number and size of brush heads in order to balance the cost of the toothbrush with the speed at which a subject's teeth may be brushed.

Figure 4:
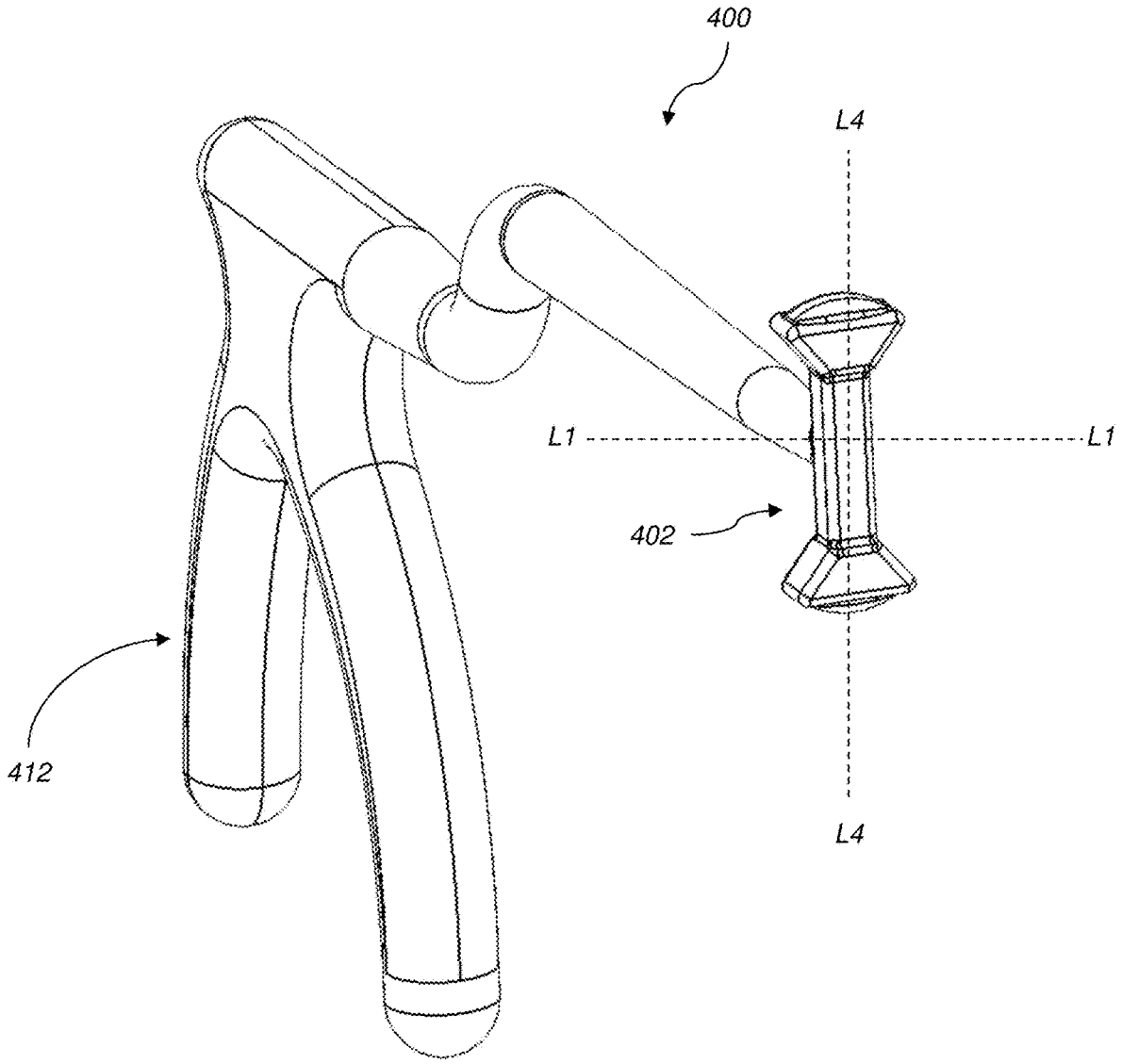
FIG. 4 depicts another toothbrush, in accordance with one or more aspects set forth herein.

FIG. 4 depicts another toothbrush 400, having a handle 412 and a toothbrush head 402. The toothbrush head 402, which is depicted with the bristles not shown. The toothbrush 500 differs from the toothbrush 100 (FIG. 1A) by the orientation of the dumbbell shaped head. As depicted in FIG. 4, toothbrush head 402 is oriented along line L4-L4 that passes through the brushing portions, instead of along orthogonal line L1-L1 like toothbrush head 102. In other embodiments, the toothbrush head may be oriented at any angle. Advantageously, this allows the provider's hand to be at a different angle with respect to the head allowing the provider to orient themselves differently relative to the subject (i.e. stand beside the subject rather than in front of them).

Figure 5:
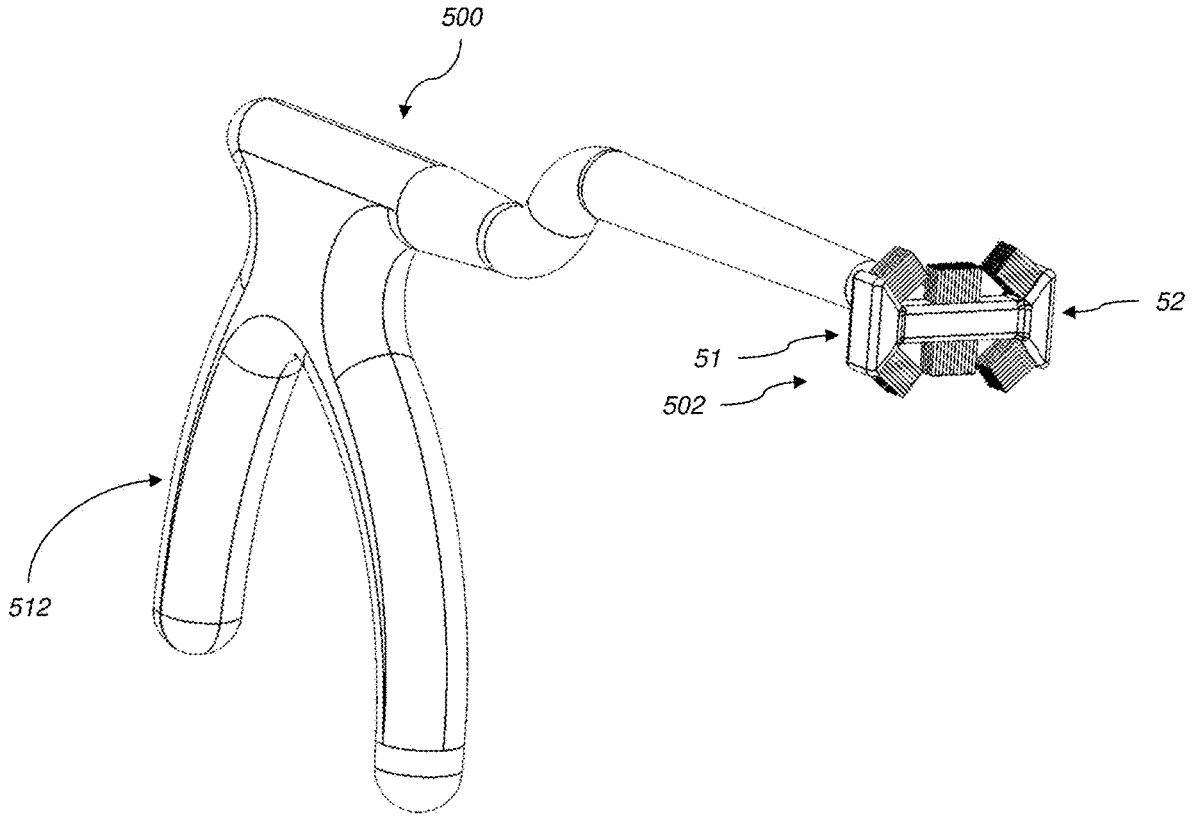
FIG. 5 depicts another toothbrush, in accordance with one or more aspects set forth herein.

FIG. 5 depicts another toothbrush 500, with a toothbrush head 502 having brushing portions 51 and 52. Notably, brushing portions 51 and 52 each have a flat shape at their extremities, unlike the convex rounded shape of brushing portions P1, P2 of FIG. 1A.

Figure 6:
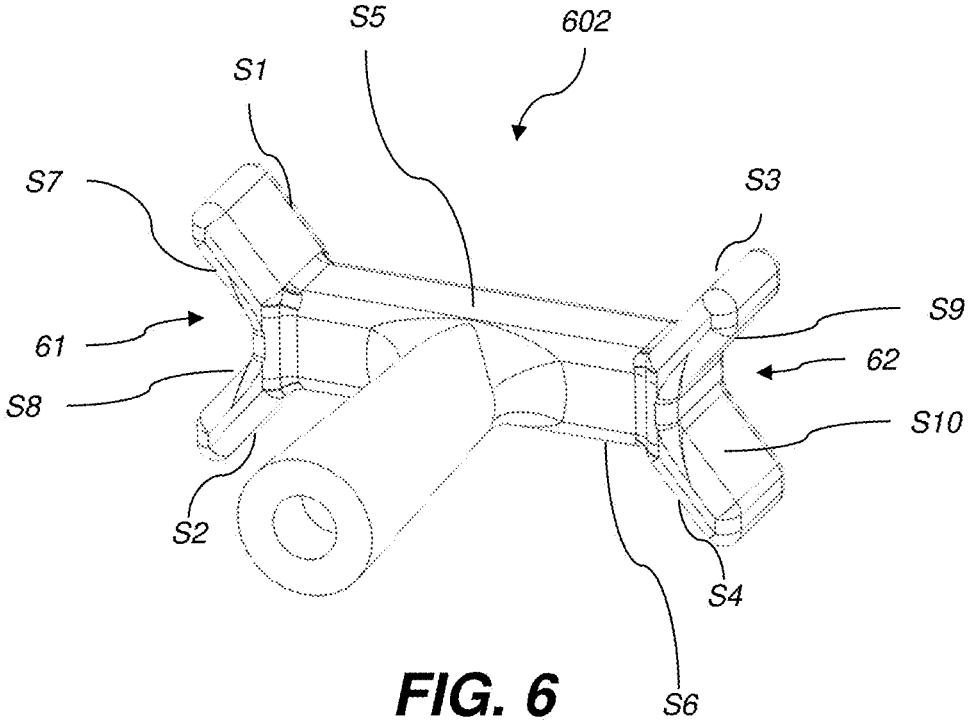
FIG. 6 depicts another toothbrush head, in accordance with one or more aspects set forth herein.

FIG. 6 depicts another toothbrush head 602 having brushing portions 61 and 62. Notably, brushing portions 61 and 62 each have a concave shape at their extremities, unlike the convex rounded shape of brushing portions P1, P2 of FIG. 1A. The concave shapes of brushing portions 61 and 62 allow for brushing surfaces S1-S6, which would be provided with bristles. The surfaces S7-S10, in the primary embodiment of FIG. 6, would not have bristles. However, in a secondary embodiment of FIG. 6, even surfaces S7-S10 could include bristles.

Figure 7A:
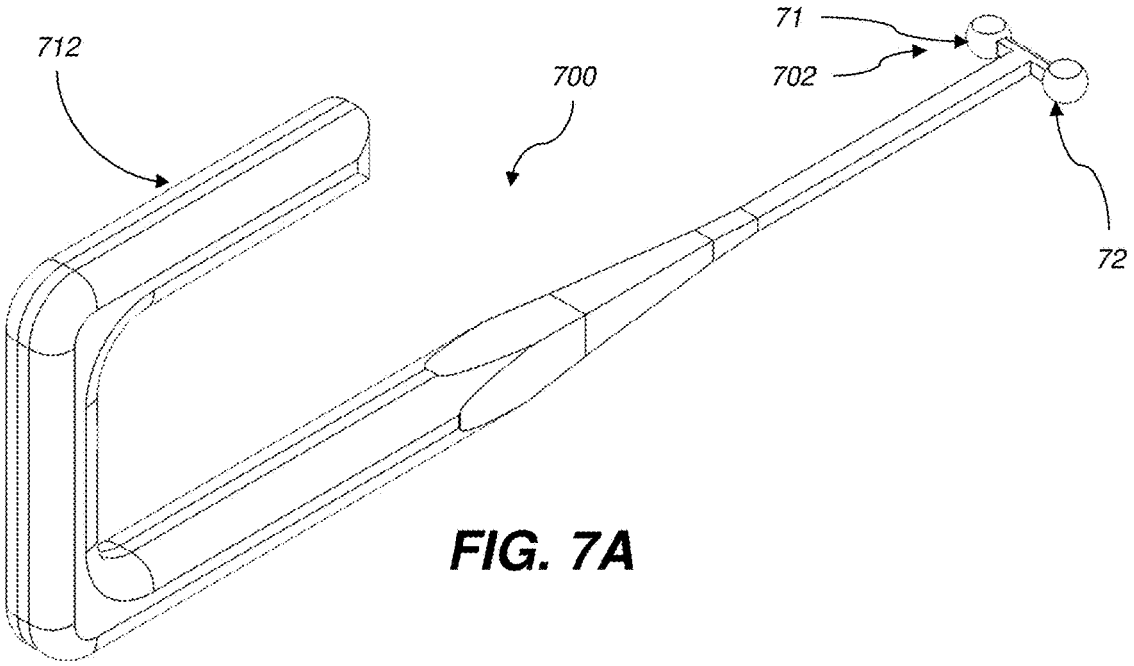
FIGS. 7A-7E depict another toothbrush, in accordance with one or more aspects set forth herein.
Figure 7B:
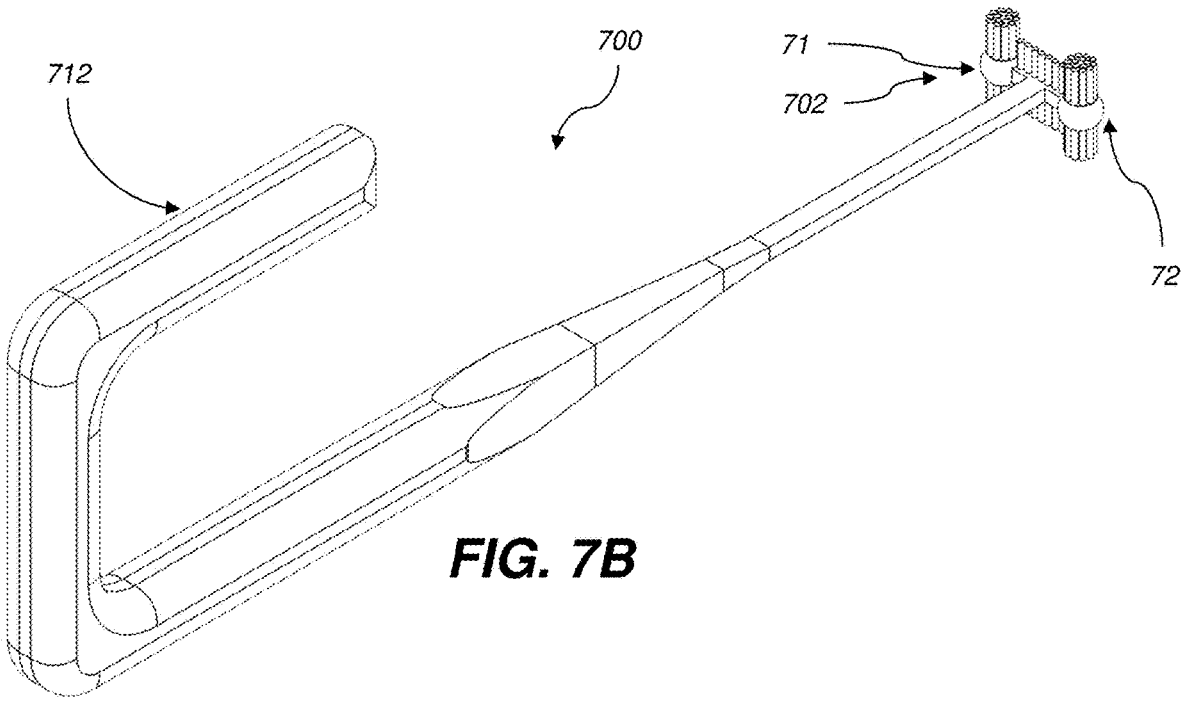
Figure 7C:
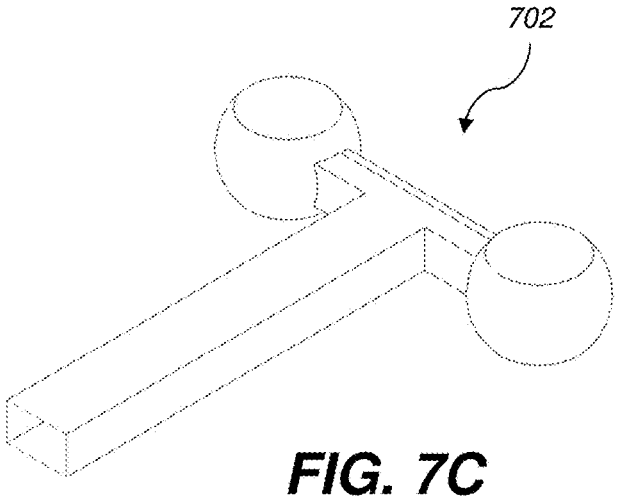
Figure 7D:
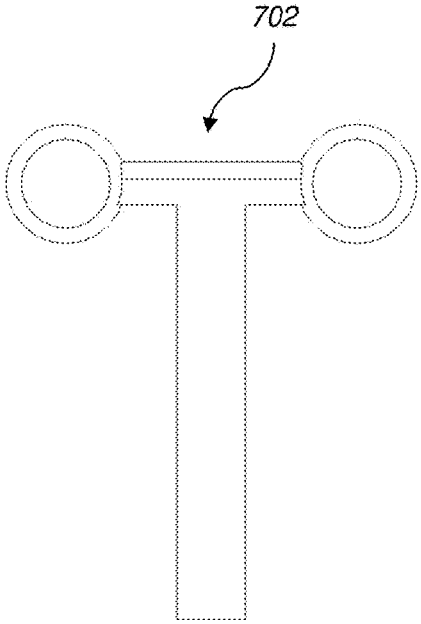
Figure 7E:
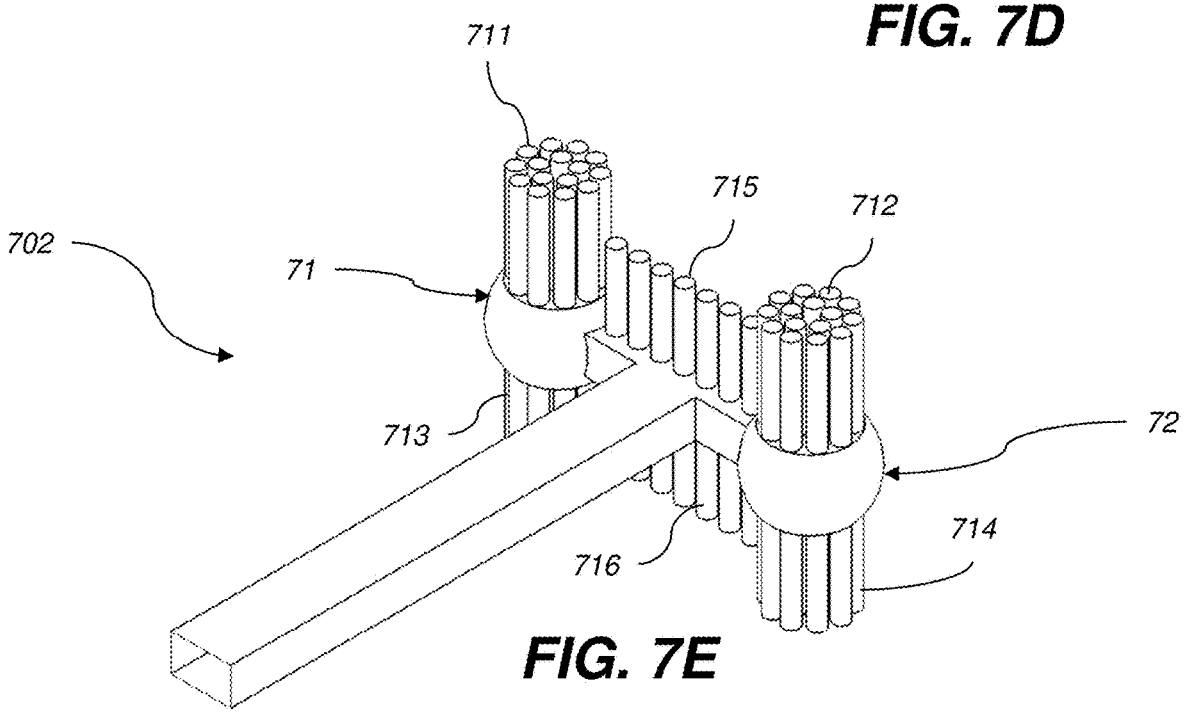

FIGS. 7A-7E depict another toothbrush 700. The toothbrush 700 has a hook handle 712 instead of the two-part grip handle 112 of FIG. 1A. In addition, the toothbrush 700 has a toothbrush head 702, in which the two brushing surfaces comprise opposite brushing surfaces. For example, as depicted in FIG. 7E, brushing surface 711 is opposite brushing surface 713, brushing surface 712 is opposite brushing surface 714, and brushing surface 715 is opposite brushing surface 716.

Figure 8:
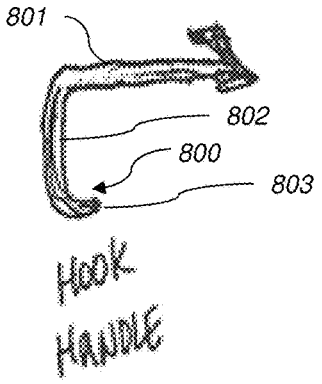
FIGS. 8-16 depict other toothbrush handles, in accordance with one or more aspects set forth herein.
Figure 9:
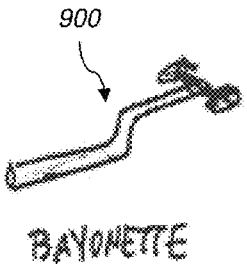
Figure 10:
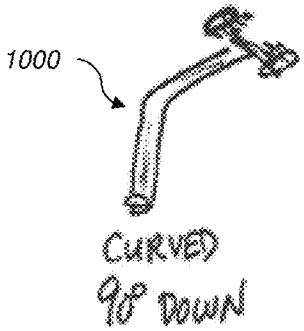
Figure 11:
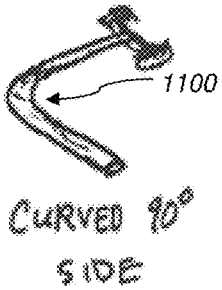
Figure 12:
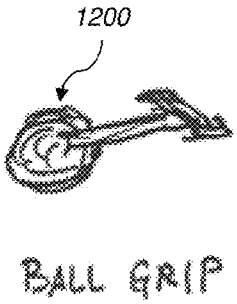
Figure 13:
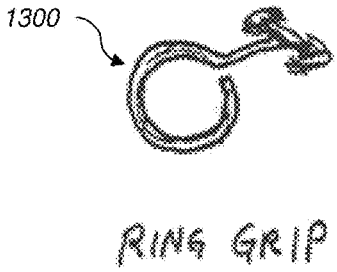
Figure 14:
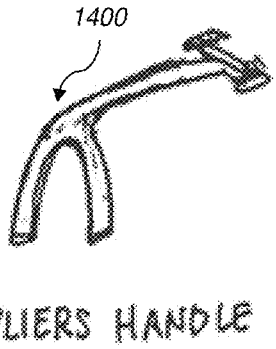
Figure 15:
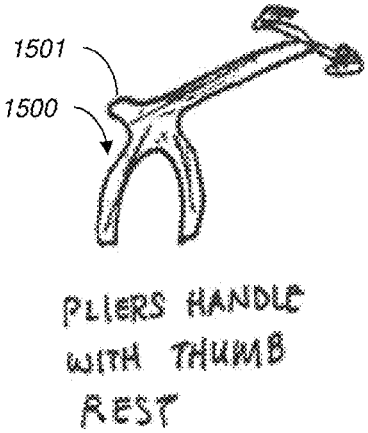
Figure 16:
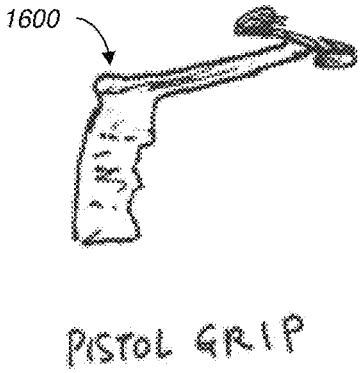

FIGS. 8-16 depict other toothbrush handles, which may be mixed and matched with any of the toothbrush heads described herein. The characteristics of these are now described. FIG. 8 depicts a hooked toothbrush handle 800 having a bottom portion 801, middle portion 802 and top portion 803. The toothbrush handle 800 may be gripped by any of the portions as needed so that the provider can approach the subject's mouth at a variety of angles. FIG. 9 depicts a bayonet toothbrush handle 900 which allows the provider to see the head of the toothbrush while gripping the handle of the toothbrush. The bayonet handle 900 does not have an additional grip portion, and thus can be produced at a lower cost than the handle of FIG. 1A. FIG. 10 depicts a 90-degree curved down toothbrush handle 1000 which may be held in an upright first grip (which may be referred to as a handshake grip or handshake position in some cases, which can include a neutral wrist, a sideways facing palm, and fingers and thumb wrapped opposably around the at least one longitudinal portion of the handle). This first (or, handshake) grip can allow visualization and better maneuverability and again may allow for a lower cost production relative to more elaborate handles, which is especially useful for disposable toothbrushes. FIG. 11 depicts a curved to the side toothbrush handle 1100 in which the handle curves sideways to allow a different angle of approach of the toothbrush head to the subject's mouth. FIG. 12 depicts a ball grip toothbrush handle 1200 which may be more comfortable to use by a provider and allow gripping at multiple angles relative to the head of the toothbrush. FIG. 13 depicts a ring grip toothbrush handle 1300 which allows gripping at multiple angles relative to the head of the toothbrush and is easy to grip for a provider with limited coordination or dexterity. The ring handle also provides a large surface area for both the provider and subject to handle the toothbrush simultaneously, for example "hand on hand" brushing. FIG. 14 depicts a plier type toothbrush handle 1400 similar to the handle of FIG. 1A. FIG. 15 depicts a plier type toothbrush handle 1500 with a thumb grip 1501 to reduce fatigue of the provider and improve fine control of the toothbrush. FIG. 16 depicts a pistol grip toothbrush handle 1600 which may also be more ergonomically pleasing to the provider.

Figure 17:
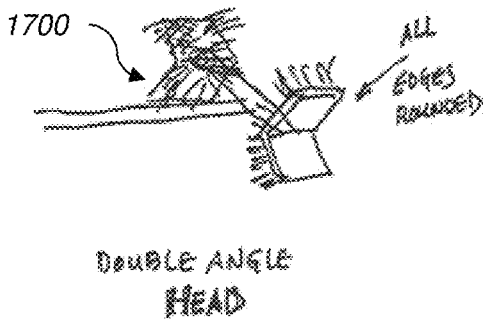
FIGS. 17-19 depict other toothbrush heads, in accordance with one or more aspects set forth herein.
Figure 18:
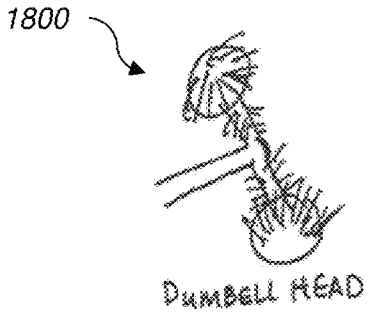
Figure 19:
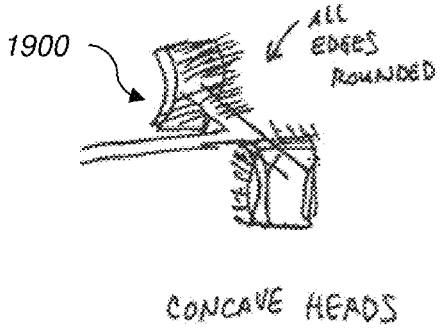

FIGS. 17-19 depict other toothbrush heads, which may be mixed and matched with any of the toothbrush handles described herein. The characteristics of these are now described. FIG. 17 depicts a toothbrush head 1700 with at least two brushing portions each having inwardly facing brushing surfaces with the bristles pointing inward. FIG. 18 depicts a toothbrush head 1800 having a round dumbbell shape, in which each of the brushing portions has a curved surface (such as a spherical surface) with bristles emerging normal to the curved surface, allowing for the bristles to be angled in such a way as to reach different tooth surfaces during brushing and rotation of the toothbrush head. FIG. 19 depicts a toothbrush head 1900 having convex portions, with the brushing surfaces being curved surfaces pointing inward to the toothbrush.

The term "approximately" as used with respect to values herein can allot for a nominal variation from absolute values, e.g., of several percent or less. Unless expressly limited by its context, the term "signal" is used herein to indicate any of its ordinary meanings, including a state of a memory location (or set of memory locations) as expressed on a wire, bus, or other transmission medium. Unless expressly limited by its context, the term "generating" is used herein to indicate any of its ordinary meanings, such as computing or otherwise producing. Unless expressly limited by its context, the term "calculating" is used herein to indicate any of its ordinary meanings, such as computing, evaluating, smoothing, and/or selecting from a plurality of values. Unless expressly limited by its context, the term "obtaining" is used to indicate any of its ordinary meanings, such as calculating, deriving, receiving (e.g., from an external device), and/or retrieving (e.g., from an array of storage elements). Where the term "comprising" is used in the present description and claims, it does not exclude other elements or operations. The term "based on" (as in "A is based on B") is used to indicate any of its ordinary meanings, including the cases (i) "based on at least" (e.g., "A is based on at least B") and, if appropriate in the particular context, (ii) "equal to" (e.g., "A is equal to B"). Similarly, the term "in response to" is used to indicate any of its ordinary meanings, including "in response to at least."

To the extent that the claims recite the phrase "at least one of" in reference to a plurality of elements, this is intended to mean at least one or more of the listed elements, and is not limited to at least one of each element. For example, "at least one of an element A, element B, and element C," is intended to indicate element A alone, or element B alone, or element C alone, or any combination thereof. "At least one of element A, element B, and element C" is not intended to be limited to at least one of an element A, at least one of an element B, and at least one of an element C.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

We claim:

1. A toothbrush comprising:

a head including an approximately dumbbell-shaped core and a set of brushing portions extending from the approximately dumbbell-shaped core, the set of brushing portions including an upper brushing portion and a lower brushing portion, wherein the upper brushing portion and the lower brushing portion are oriented and spaced apart relative to one another to enable a provider to brush upper teeth and lower teeth of another person without removing the head from the mouth of the other person, wherein the head enables brushing of an entirety of the teeth of the other person without removing the head from the mouth of the other person, and wherein the head enables brushing the upper teeth and the lower teeth of the other person without rotating the handle more than 90 degrees along an axis of the handle, and wherein the upper brushing portion includes three distinct upper brushing surfaces and wherein the lower brushing portion includes three distinct lower brushing surfaces, each of the distinct brushing surfaces having a set of bristles for brushing the teeth of the other person, and a handle coupled with the head, the handle including:

at least one longitudinal portion positioned relative to the head such that a hand of the provider is oriented at a distinct angle from the head while brushing the teeth of the other person and holding the at least one longitudinal portion, wherein the at least one longitudinal portion of the handle includes two distinct longitudinal portions that are offset from one another by a connecting portion to facilitate the user viewing the mouth of the other person while brushing the teeth, and at least two distinct grip portions extending from the at least one longitudinal portion, the at least two distinct grip portions including a forward grip portion and a rear grip portion, the forward grip portion being longer than the rear grip portion, wherein the at least two distinct grip portions extend from a rear one of the two distinct longitudinal portions, and wherein the forward grip portion and the rear grip portion each extend only from one side of the rear one of the two distinct longitudinal portions.

2. The toothbrush of claim 1, wherein the one side is a bottom side of the rear one of the two distinct longitudinal portions when the toothbrush is positioned in an upright use position in the mouth of the other person.

3. The toothbrush of claim 1, wherein the rear one of the two distinct longitudinal portions includes a neck from which each of the two distinct grip portions extends, the neck including a taper from the rear one of the two distinct longitudinal portions.

4. The toothbrush of claim 3, wherein each of the forward grip portion and the rear grip portion includes a proximal portion coupled with the neck and a distal portion opposite the proximal portion, and wherein a distance between the distal portion of the forward grip portion and the distal portion of the rear grip portion is greater than a width of the neck.

5. The toothbrush of claim 4, wherein the neck is directly connected to the rear one of the two distinct longitudinal portions and separates the rear one of the two distinct longitudinal portions from the forward grip portion and the rear grip portion.

6. The toothbrush of claim 1, wherein each of the forward grip portion and the rear grip portion is asymmetric relative to a primary axis of the rear one of the two distinct longitudinal portions.

7. The toothbrush of claim 1, wherein the at least two grip portions approximate an offset V-shape or an offset U-shape.

8. The toothbrush of claim 1, wherein, with the toothbrush in a use position, the forward grip portion and the rear grip portion are each positioned on the one side of the rear one of the two distinct longitudinal portions such that the hand of the provider is entirely on the one side of the rear one of the two distinct longitudinal portions.

9. The toothbrush of claim 1, wherein the forward grip portion is spaced from the rear grip portion to enable one hand of the other person to grip the forward grip portion and one hand of the provider to grip the rear grip portion.

10. The toothbrush of claim 9, wherein the spacing between the forward grip portion and the rear grip portion is sufficient to accommodate the other person holding the forward grip portion while the provider holds the rear grip portion.

11. The toothbrush of claim 1, wherein the forward grip portion and the rear grip portion are spaced apart by a distance sufficient to enable a distinct hand to grip each of the forward grip portion and the rear grip portion simultaneously.

12. A method of brushing the teeth of another person, performed by a provider, the method comprising:

at least partially inserting a toothbrush into the mouth of the other person, with the toothbrush in the mouth of the other person:

a) contacting an inside of at least one upper tooth and concurrently contacting an outside of at least one lower tooth, and b) contacting an inside of at least one lower tooth and concurrently contacting an outside of at least one upper tooth, wherein (a) and (b) are performed without removing the toothbrush from the mouth of the other person, and wherein the toothbrush includes:

a head including an approximately dumbbell-shaped core and a set of brushing portions extending from the approximately dumbbell-shaped core, the set of brushing portions including an upper brushing portion and a lower brushing portion, wherein the upper brushing portion and the lower brushing portion are oriented and spaced apart relative to one another to enable a user of the toothbrush to brush upper teeth and lower teeth of another person without removing the toothbrush from the mouth of the other person, and a handle coupled with the head, the handle including:

at least one longitudinal portion positioned relative to the head such that a hand of the provider is oriented at a distinct angle from the head while brushing the teeth of the other person and holding the at least one longitudinal portion, wherein the at least one longitudinal portion of the handle is positioned relative to the head to enable the hand of the provider to remain in a handshake position while brushing the teeth of the other person, and at least two distinct grip portions extending from the at least one longitudinal portion, the at least two distinct grip portions including a forward grip portion and a rear grip portion, the forward grip portion being longer than the rear grip portion, wherein the handle further includes an offset from the head allowing the user to view the mouth of the other person while brushing the upper teeth and the lower teeth, wherein the rear one of the two distinct longitudinal portions includes a neck from which each of the two distinct grip portions extends, wherein each of the forward grip portion and the rear grip portion includes a proximal portion coupled with the neck and a distal portion opposite the proximal portion, and wherein a distance between the distal end of the forward grip portion and the distal end of the rear grip portion is greater than a width of the neck, wherein each of the forward grip portion and the rear grip portion is asymmetric relative to a primary axis of the rear one of the two distinct longitudinal portions, wherein, with the toothbrush in a use position, the forward grip portion and the rear grip portion are positioned on the one side of the rear one of the two distinct longitudinal portions such that the hand of the provider is entirely on the one side of the rear one of the two distinct longitudinal portions, and wherein the head enables brushing of an entirety of the teeth of the other person without removing the head from the mouth of the other person.

13. The method of claim 12, wherein the neck includes a taper from the rear one of the two distinct longitudinal portions.

14. A toothbrush comprising:

a head including an approximately dumbbell-shaped core and a set of brushing portions extending from the approximately dumbbell-shaped core, the set of brushing portions including an upper brushing portion and a lower brushing portion, wherein the upper brushing portion and the lower brushing portion are oriented and spaced apart relative to one another to enable a user of the toothbrush to brush upper teeth and lower teeth of a subject without removing the toothbrush from the mouth of the subject, and a handle coupled with the head, the handle including:

at least one longitudinal portion positioned relative to the head such that a hand of the provider is oriented at a distinct angle from the head while brushing the teeth of the subject and holding the at least one longitudinal portion, wherein the at least one longitudinal portion of the handle further comprises a first longitudinal portion approximately parallel with, and offset from a second longitudinal portion, and a connecting portion between the first longitudinal portion and the second longitudinal portion, wherein the first longitudinal portion is coupled with the head, and wherein the offset between the first longitudinal portion and the second longitudinal portion prevents the handle from blocking the provider's view of the subject's mouth during brushing, at least two distinct grip portions extending from the at least one longitudinal portion, the at least two distinct grip portions including a forward grip portion and a rear grip portion, the forward grip portion being longer than the rear grip portion, wherein the head:

allows the user to view the mouth of the subject while brushing the upper teeth and the lower teeth, and enables brushing of an entirety of the teeth of the subject without removing the head from the mouth of the subject, wherein the at least two distinct grip portions extend from the second longitudinal portion, wherein the forward grip portion is closer to the head than the rear grip portion, wherein the connecting portion includes at least one bend, wherein the upper brushing portion and the lower brushing portion are connected by the approximately dumbbell shaped core and wherein the approximately dumbbell shaped core has a convex rounded shape at extremities thereof, and wherein the forward grip portion and the rear grip portion each extend only from one side of the rear one of the two distinct longitudinal portions, wherein the forward grip portion is spaced from the rear grip portion to enable one hand of the subject to grip the forward grip portion and one hand of the provider to grip the rear grip portion.

15. The toothbrush of claim 14, wherein the rear one of the two distinct longitudinal portions includes a neck from which each of the two distinct grip portions extends, the neck including a taper from the rear one of the two distinct longitudinal portions, and wherein each of the forward grip portion and the rear grip portion includes a proximal portion coupled with the neck and a distal portion opposite the proximal portion, and wherein a distance between the distal end of the forward grip portion and the distal end of the rear grip portion is greater than a width of the neck.

16. The toothbrush of claim 15, wherein the neck is directly connected to the rear one of the two distinct longitudinal portions and separates the rear one of the two distinct longitudinal portions from the forward grip portion and the rear grip portion.

* * * * *